United States Patent [19]

Waters

[11] 4,122,626

[45] Oct. 31, 1978

[54] TOY GLIDER

[76] Inventor: John R. Waters, 9221 SE. 55th Ave., Portland, Oreg. 97206

[21] Appl. No.: 728,934

[22] Filed: Oct. 4, 1976

[51] Int. Cl.[2] ..... A63H 33/00

[52] U.S. Cl. ..... 46/11; 46/79

[58] Field of Search ..... 46/1 R, 1 L, 11, 74 R, 46/76 R, 79, 80, 81, 78; 229/8, 1.5 B

[56] References Cited

U.S. PATENT DOCUMENTS

| | | | |
|---|---|---|---|
| 1,758,399 | 9/1928 | Hodgdon | 46/76 |
| 3,153,877 | 10/1964 | Effinger, Jr. et al. | 46/78 |
| 3,576,086 | 4/1971 | Halsey | 46/79 |
| 3,739,975 | 6/1973 | Davidow | 229/8 |
| 3,946,519 | 3/1976 | Vadik et al. | 46/79 |

FOREIGN PATENT DOCUMENTS

| | | | |
|---|---|---|---|
| 243,943 | 12/1925 | United Kingdom | 46/79 |

*Primary Examiner*—Russell R. Kinsey
*Assistant Examiner*—Mickey Yu
*Attorney, Agent, or Firm*—Eugene M. Eckelman

[57] ABSTRACT

A pair of arched wings are secured together at their inner ends by a connecting member to form a body portion. A weight is secured to the body portion to provide proper balance in flight. The wings have an upwardly arched configuration which may be accomplished either by molding them in such configuration or by constructing them from a blank which has a curvature therein such as from a cylindrical tubular member. In one embodiment, the wings have a reduced radius toward the front to provide a hang glider type construction which requires no tail.

4 Claims, 11 Drawing Figures

TOY GLIDER

BACKGROUND OF THE INVENTION

This invention relates to new and useful toy glider constructions and to a process of forming same.

SUMMARY OF THE INVENTION

According to the present invention and forming a primary objective thereof, a toy glider has two wings connected together at their inner ends to form a body portion, and weight means are secured to such body portion to provide proper balance in flight. The wings may be molded in their curved configuration or constructed from a curved blank of material such as a container or curved label. In this latter regard, the present glider may for example be constructed from styrofoam cups or from bottle labels which may have served a function prior to being made into a glider. One embodiment has a reduced radius of curvature for the wings toward the front to provide stability in flight without a tail.

The invention will be better understood and additional objects and advantages will become apparent from the following description taken in connection with the accompanying drawings.

DETAILED DESCRIPTION OF A PREFERRED EMBODIMENT

Figure 2:
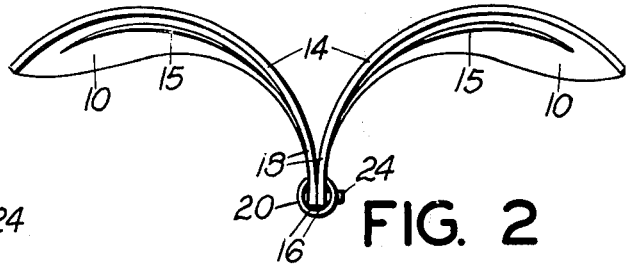
FIG. 2 is a rear elevational view of the glider taken on the line 2—2 of FIG. 1.

With particular reference first to FIGS. 1-5, a first form of glider of the invention has a pair of wings 10 which when viewed from the front are upwardly arched. The radius of curvature of the wings is substantially uniform throughout the length of the wings as best seen in FIG. 2, or in other words the wings comprise a portion of a circle. The front and side edges 12 of the wings have a convex curvature, and such curvature is substantially uniform throughout its length. The rearward edges 14 of the wings have a concave curvature as best seen in the top plan view of FIG. 3. The front and rear shaping of the glider is for illustration purposes only, and it is to be understood that other wing shapes, except for the upward arching, may be provided. The wings 10 may have cut-out portions 15 if desired.

Figure 4:
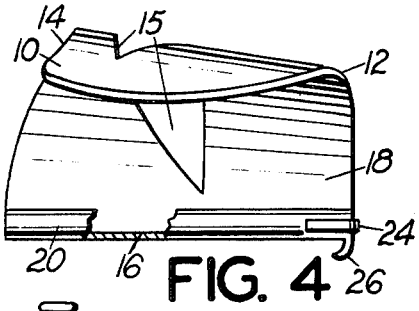
FIG. 4 is a fragmentary side elevational view.

The wings have a straight inner or bottom edge 16, FIG. 4, and said wings are secured together along this inner edge to form a body portion 18. These edge portions of the wings may be secured together by a split connecting member 20 preferably constructed of a spring type material or a ductile material whereby the connecting member can be clamped on the wings. The member 20 may extend only partially the length of the wings or as shown it may extend the full length. If desired, other means may be used for connecting the wings together at the bottom, such as adhesive, a tape having pressure sensitive adhesive thereon, etc.

Figure 5:
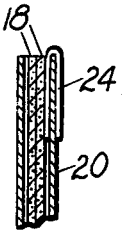
FIG. 5 is a fragmentary sectional view taken on the line 5—5 of FIG. 1.
Figure 9:
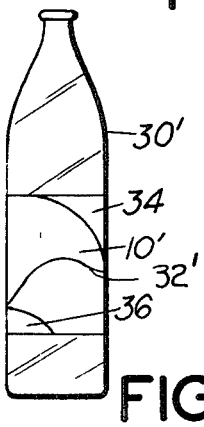
FIG. 9 is an elevational view of another form of tubular member from which the glider can be formed.
Figure 11:
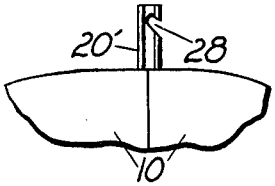
FIG. 11 is a fragmentary top plan view of a glider showing a modified form of connecting member.
Figure 3:
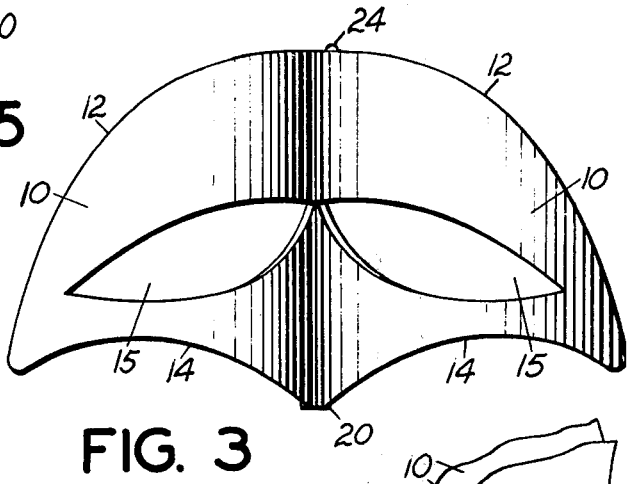
FIG. 3 is a top plan view of the glider.

A weight 24 is applied to the front of the glider, and for this purpose such weight may be U-shaped and arranged to have a friction fit on a wall portion of the connecting member 20 from the front, as best seen in FIG. 5. The connecting member 20 has a reversely turned hook 26 depending from a forward portion thereof for engagement by an elastic launching member such as a rubber band. With regard also to launching means for the glider, and with reference to FIG. 11, the connecting member 20 may extend forward of the wings and be provided with a side opening 28 which faces obliquely to the rear. By means of this opening, the glider can be hooked to a kite string so as to be moved up the string by the wind and then after it reaches the desired height it can be separated from the kite string by shaking the latter.

Figure 6:
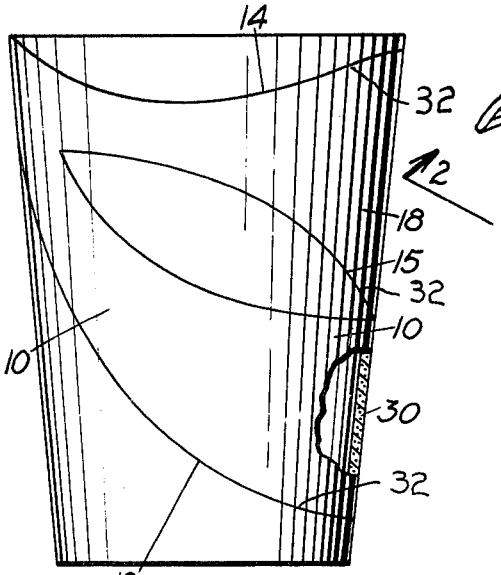
FIG. 6 is an elevational view of one form of tubular member from which the glider of FIGS. 1-5 may be formed.
Figure 1:
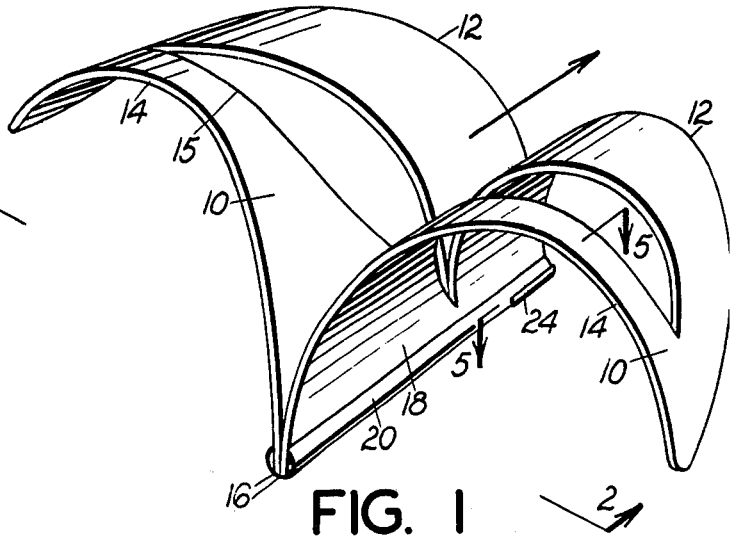
FIG. 1 is a perspective view of a first form of glider embodying features of the instant invention.

As a feature of the embodiment of FIGS. 1-5, the wings have a reduced radius toward the front to produce an air flow under the wings that lifts and stabilizes the tail end. Thus, such an embodiment operates similar to a hang glider and requires no tail. This shape of the wings can be accomplished by molding, or the wings can be formed from a tapered container 30, FIG. 6, which not only forms the arch in the wings but also the forwardly reduced radius of the wings. Further yet, the container 30 may first be used to merchandise a product such as popcorn, soft drinks, etc. and after such function, it can be used by the customer to form the wings of a glider. As shown in FIG. 6, the wings 10 are marked by lines or by perforations 32 whereby when it is desired to remove the wings from the cup they are cut or punched therefrom. The numeral 12 in FIG. 6 designates the front convex curvature of one of the wings before separation from the cup and the numeral 14 designates the rear concave curvature of one of the wings.

A good representative material for a container from which the glider can be formed is a plastic foam such as styrofoam. Other material of course can be used but it necessarily must have sufficient structural strength as to maintain the wing curvature. In addition to the necessary structural strength, it is desired that the material be light in weight and have a resilience so as to be tough in use.

Figure 7:
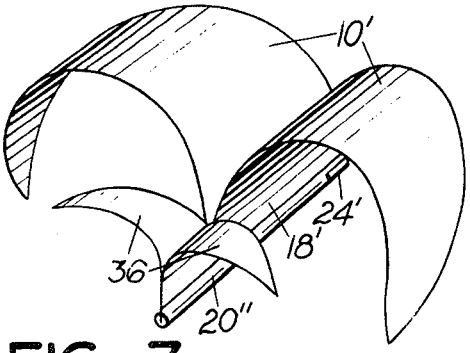
FIG. 7 is a perspective view of a second form of glider embodying features of the instant invention.
Figure 8:
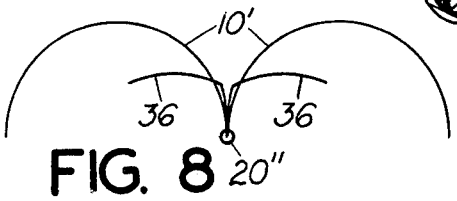
FIG. 8 is a rear elevational view of the glider of FIG. 7.

FIGS. 7 and 8 show a somewhat modified form of glider which employs principles of the present invention. This glider, similar to the embodiment of FIG. 1, employs a pair of arched wings 10' connected together in a body portion 18' by a connecting member 20''. A weight 24' is employed which is similar to the weight 24 in FIG. 1. The embodiment of FIGS. 7 and 8 illustrates a concept wherein a toy glider can in one construction thereof be formed from a label 34 or the like from a bottle 30'. As in the illustration of FIG. 6, the blank 34 may also be provided with lines or perforations 32' for cutting or punching out the wings.

In the embodiment of FIGS. 7 and 8, the blank 34 is of uniform diameter and thus in order to provide stability in the air, tail portions 36 are provided. In this regard, each wing has a tail portion 36 combined therewith which is formed by cutting or punching on selected lines 32′ on the blank. The tail portions 36 assume the same curvature as the wings since they too receive their curvature from the curved blank.

Figure 10:
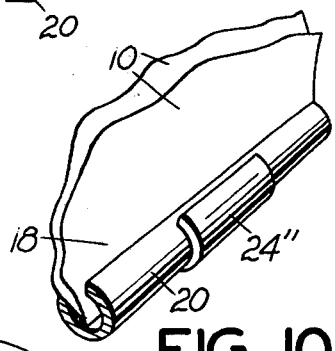
FIG. 10 is a fragmentary perspective view showing a second embodiment of weight means adapted for use with the glider.

FIG. 10 shows an alternative form of weight 24″ comprising a split tube arranged to fasten over the connecting member 20. The weight 24″ may be made of lead or other ductile material for easy clamping on the connecting member.

It is to be understood that the forms of my invention herein shown and described are to be taken as preferred examples of the same and that various other changes in the shape, size and arrangement of parts may be resorted to without departing from the spirit of my invention or the scope of the subjoined claims.

Having thus described my invention, I claim:

1. A toy glider comprising (a) a pair of wings having inner and outer ends as well as forward and rearward ends, (b) the forward ends of said wings having a rounded curvature, (c) each of said wings being formed from a curved blank of material and having an upwardly arched configuration provided by the curve of the blank material, (d) said curved blank of material comprising a container which is tapered so as to form wings of reduced radius toward the forward end, (e) said wings being formed of a material having sufficient rigidity to be self-sustaining in said arched configuration, (f) means connecting said wings together at their inner ends to form a body portion, (g) and weight means secured to the body portion at the forward end of said wings.

2. The toy glider of claim 1 wherein said container has markings thereon outlining the shape of the wings for detachment from the container.

3. The toy glider of claim 1 wherein said container has perforations therein the outline of which is the shape of the wings whereby said wings can be removed from said container at said perforations.

4. The toy glider of claim 1 wherein said curved blank of material comprises a cylindrical bottle label.

* * * * *